US009170009B1

(12) United States Patent
Smith

(10) Patent No.: US 9,170,009 B1
(45) Date of Patent: Oct. 27, 2015

(54) ONE-HANDED ACTIVATION DEVICE

(76) Inventor: Paul N. Smith, Bangor, ME (US)

( * ) Notice: Subject to any disclaimer, the term of this patent is extended or adjusted under 35 U.S.C. 154(b) by 341 days.

(21) Appl. No.: 13/221,787

(22) Filed: Aug. 30, 2011

(51) Int. Cl.
*F21V 21/08* (2006.01)
*F21V 23/04* (2006.01)

(52) U.S. Cl.
CPC ..... *F21V 23/0414* (2013.01)

(58) Field of Classification Search
CPC .. A41D 19/0037; A41D 19/0157; F21L 4/00; F21L 11/00; F21V 21/0832; F21V 23/0414; F21W 2101/02; F21W 2101/12; F21W 2101/14; F21W 2111/00; F21W 2111/10; F21Y 2101/02; H01H 1/00; H01H 2009/0221
USPC ..... 362/8, 103, 104, 183, 184, 190, 191, 362/205, 249.01, 249.02, 249.05, 249.12, 362/554, 555, 570, 573, 800, 804
See application file for complete search history.

(56) References Cited

U.S. PATENT DOCUMENTS

| | | | | | |
|---|---|---|---|---|---|
| 3,638,011 | A | | 1/1972 | Bain | |
| 5,086,378 | A | | 2/1992 | Prince | |
| 5,124,892 | A | | 6/1992 | Lambert | |
| 5,177,467 | A | * | 1/1993 | Chung-Piao | 340/574 |
| 5,242,440 | A | * | 9/1993 | Shippert | 606/30 |
| 5,255,167 | A | | 10/1993 | Toussaint | |
| 5,283,722 | A | * | 2/1994 | Koenen et al. | 362/570 |
| 5,365,213 | A | * | 11/1994 | Paull et al. | 340/321 |
| 5,450,293 | A | | 9/1995 | Hoffman | |
| 5,580,154 | A | | 12/1996 | Coulter | |
| 5,816,676 | A | | 10/1998 | Myers | |
| 6,141,643 | A | * | 10/2000 | Harmon | 704/271 |
| 6,529,121 | B2 | | 3/2003 | Bush | |
| 6,592,235 | B1 | | 7/2003 | Mayo | |
| 6,709,142 | B2 | | 3/2004 | Gyori | |
| 6,892,397 | B2 | | 5/2005 | Raz | |
| 6,902,289 | B1 | | 6/2005 | Smith | |
| 7,013,490 | B2 | | 3/2006 | Senter | |
| 7,152,248 | B2 | | 12/2006 | Ziemer | |
| 7,163,308 | B2 | | 1/2007 | Ferrari | |
| 7,347,578 | B1 | * | 3/2008 | Nourse | 362/103 |
| 7,503,667 | B2 | | 3/2009 | Wilkings | |
| 7,703,937 | B2 | | 4/2010 | Shirey | |
| 7,959,314 | B1 | * | 6/2011 | Rodriguez | 362/103 |
| 2006/0250256 | A1 | * | 11/2006 | Power | 340/575 |
| 2008/0062676 | A1 | * | 3/2008 | Masuda | 362/103 |

* cited by examiner

*Primary Examiner* — Hargobind S Sawhney
(74) *Attorney, Agent, or Firm* — Christensen O'Connor Johnson Kindness PLLC

(57) ABSTRACT

A one-handed activation device includes a hand attachment assembly having an activatable device attachment portion securable to at least a portion of a user's hand and a first switch portion securable to at least a portion of one of a proximal phalanx of a user's thumb and a middle phalanx of a user's finger. The one-handed activation device further includes an activatable device configured to be selectively activated that is secured to the activatable device attachment portion and a first switch configured to selectively activate the activatable device. The first switch is secured to the first switch portion and it is positioned such that the first switch substantially overlies an extensor surface of one of the proximal phalanx of the user's thumb and the middle phalanx of the user's finger.

14 Claims, 5 Drawing Sheets

ONE-HANDED ACTIVATION DEVICE

BACKGROUND

Often a user must grasp or otherwise manipulate an object with the fingers of his or her hand. It is often the case that proper illumination of the object to be manipulated is essential, especially in low light environments, so that the user may both locate and properly manipulate the object. This is especially true in "close work" situations, where the user must locate small objects and perform small, intricate movements upon the object.

For instance, when healthcare professionals examine or operate upon patients, a brightly illuminated work surface is essential, especially at the fingertips of the healthcare professional's hand. This is also true in the electronic parts assembly field or for pilots when flying at night in cockpits dimmed to improve visibility of objects outside of the cockpit. In the instance of a pilot, the dimmed cockpit makes locating and operating the control switches of the airplane difficult without the use of illumination devices. Other areas of work which may includes similar situations include those of a plumber, a mariner, a policeman, a fireman, an electrician, etc.

To address this problem, several hand illumination assemblies have been developed that illuminate an object being grasped by the user's fingers. For instance, in U.S. Pat. No. 6,902,289, entitled "Illuminated Hand Cover Assembly," filed on Jun. 4, 2003, an illuminated hand cover assembly is shown and described that directs the axis of illumination of the light source at the palmar surface of the fingertips of the user.

When using such a hand illumination assembly, the wearer is often using the opposite hand to hold or touch an object. In such situations, it is extraordinarily useful for the wearer to be able to activate the illumination device with the hand wearing the device. Known prior art devices that include switches on the same hand as the illumination device are not ideally placed such that the user can easily access the switch with that same hand.

For instance, in known prior art devices, the switch may be located on the wrist, the cuff, or the back of the hand, which requires the user to use his or her opposite hand to activate the switch. Other known prior art devices locate the switch on the palmar surface of the hand or adjacent to the palmar surface, which is the surface involved when gripping an object and can therefore cause inadvertent activation of the switch. Yet other known prior art devices locate the switch on the index finger of the user to be accessed by the thumb; however, the switch is not accessible by the other fingers of the hand.

Therefore, there exists a need for a one-handed activation device having a switch that is configured to selectively activate an activatable device, such as an illumination assembly, wherein the switch is located on the user's hand such that the user can easily activate the switch with that same hand.

SUMMARY

A one-handed activation device includes a hand attachment assembly having an activatable device attachment portion securable to at least a portion of a user's hand and a first switch portion securable to at least a portion of a surface of one of a proximal phalanx of a user's thumb and a middle phalanx of a user's finger. The one-handed activation device further includes an activatable device configured to be selectively activated that is secured to the activatable device attachment portion and a first switch configured to selectively activate the activatable device. The first switch is secured to a surface of the first switch portion and it is positioned such that the first switch substantially overlies an extensor surface of one of the proximal phalanx of the user's thumb and the middle phalanx of the user's finger.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
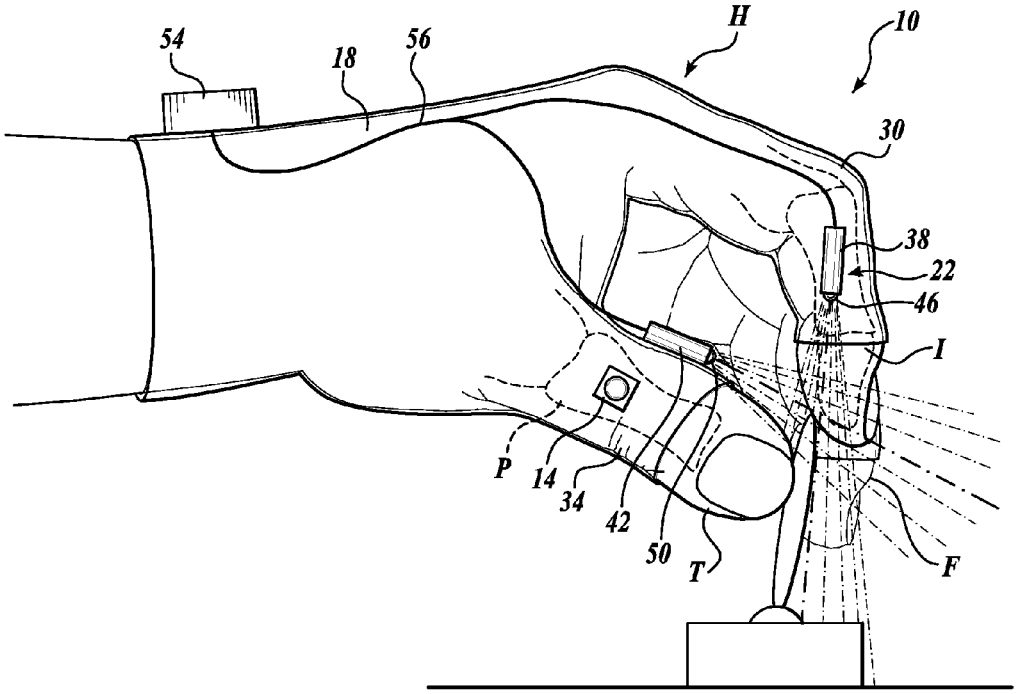
FIG. 1 is an environmental view of a one-handed activation device shown in use with an activated illumination assembly.

An exemplary embodiment of a one-handed activation device 10 formed in accordance with the present disclosure may best be seen by referring to FIG. 1. The one-handed activation device 10 generally includes at least a first switch 14 secured to a thumb portion or a finger portion of a hand attachment assembly 18, wherein the first switch substantially overlies a dorsal or extensor surface of the thumb or a finger of the user's hand. The first switch is configured to selectively activate an activatable device, such as an illumination device or assembly 22 secured to a portion of the hand attachment assembly 18.

Although the one-handed activation device 10 will be shown and described with reference to an illumination device, it should be appreciated that the one-handed activation device 10 may instead be used to activate any suitable activation device, such as an alarm, a sensor, a tool, or any other suitable device that is activatable through a switch, either wirelessly or through wired means. In that regard, the activatable device may be secured to the hand attachment assembly 18 for activation by the first switch 14 by wired or wireless means, or the activatable device may instead be located on a separate assembly and controlled wirelessly through the first switch 14. For instance, the first switch 14 may be used to control an illumination device secured to a headband worn by a user. Thus, it should be appreciated that the descriptions and illustrations provided herein are not intended to limit the scope of the claimed subject matter.

Figure 2:
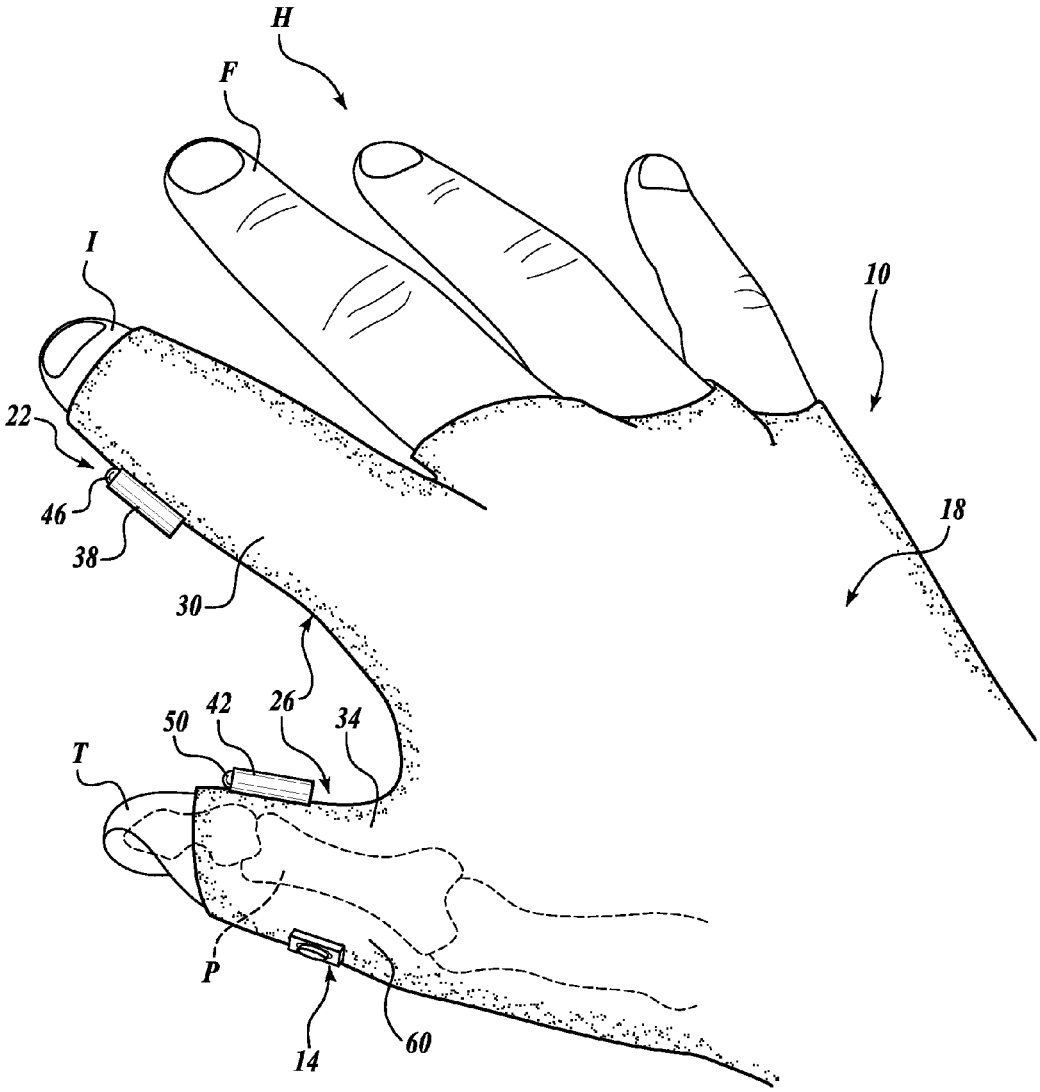
FIG. 2 is an isometric view of a first embodiment of one-handed activation device having a first switch on a surface of the one-handed activation device.

Referring additionally to FIG. 2, the one-handed activation device 10 will now be described in detail. The one-handed activation device 10 includes a hand attachment assembly 18 that is configured to be secured to at least a portion of a user's hand H. In the illustrated embodiment, the hand attachment assembly 18 is embodied as a fingerless glove; however, it should be appreciated that the hand attachment assembly 18 may instead be any other suitable assembly that covers, partially covers, or otherwise attaches to the hand H when the hand attachment assembly 18 is donned.

The hand attachment assembly 18 includes an activatable device attachment portion 26 securable to at least a portion of a user's hand or fingers for securing components of the illumination assembly 22 to the user's hand. In the depicted embodiment, the activatable device attachment portion 26 is configured as an index finger portion 30 and a thumb portion 34 of the hand attachment assembly 18. Both the index finger portion 30 and the thumb portion 34 enclose and extend at least partially along the length of the index finger I and the thumb T, respectively, when donned, although the tip of the index finger I and thumb T may be exposed for ease of use.

In the depicted embodiment, the illumination assembly 22 includes a first light source 38 secured to the index finger portion 30 and a second light source 42 secured to the thumb portion 34. The first and second light sources 38 and 42 may be any suitable light source, such as a light emitting diode (LED), a fiber optic light source, an incandescent light source, a halogen light source, or another light source. Each of the first and second light sources 38 and 42 includes first and second light emission areas 46 and 50, such as a lens, aperture, etc., wherein the light generated by the light source 38 or 42 is emitted.

The first and second light sources 38 and 42 are secured to the index finger portion 30 and the thumb portion 34 in any suitable manner, such as by adhesive, by sewing, etc. Moreover, the first and second light sources 38 and 42 may be positioned on the index finger portion 30 and the thumb portion 34 in any desired location. For instance, the first and second light sources may be secured to the outer surface of the index finger portion 30 and the thumb portion 34. In the alternative, the first and second light sources may be secured to the inner surface of the index finger portion 30 and the thumb portion 34 with the first and second light emission areas 46 and 50 positioned to shine light through a transparent portion or opening in the hand attachment assembly 18.

The first and second light sources 38 and 42 may be positioned on the index finger portion 30 and the thumb portion 34 such that the first and second light emission areas 46 and 50 are positioned to shine light generally in front of the index finger tip and the thumb tip. As a specific example, the first and second light sources 38 and 42 may be mounted to the index finger portion 30 and the thumb portion 34 as shown and described in U.S. Pat. No. 6,902,289, entitled "Illuminated Hand Cover Assembly," filed on Jun. 4, 2003, the disclosure of which is hereby expressly incorporated herein by reference. The first and second light sources 38 and 42 may be electrically connected to an energy source 54, such as a battery, through a wiring assembly 56 (not shown in FIG. 2 for simplicity).

The hand attachment assembly 18 further includes a first switch portion 60 securable to at least a portion of either a user's thumb or a user's finger. The first switch portion 60 is configured to secure the first switch 14 in a predetermined, accessible location on a user's thumb or finger when donned.

The first switch 14 is any suitable switch that is configured to selectively activate the illumination assembly 22. For instance, the first switch 14 may be a push-button switch, a toggle switch, an in-line switch, a rocker switch, etc. As shown in FIG. 1, the first switch 14 may be placed into electrical connection with the first and second light sources 38 and 42 of the illumination assembly 22 through the wiring assembly 56. However, it should be appreciated that the first switch 14 may instead communicate with the first and second light sources 38 and 42 wirelessly or by other suitable means.

In the embodiment depicted in FIGS. 1 and 2, the first switch portion 60 covers a portion of the user's thumb T. In that regard, the first switch portion 60 is substantially identical to the thumb portion 34 described above. However, the first switch portion 60 will hereinafter be described as being used to secure and position the switch 14 on the user's thumb. In that regard, the first switch portion 60 will be considered separate and independent from the thumb portion 34 of the activatable device attachment portion 26 and will be hereinafter described separately.

The first switch portion 60 substantially covers the proximal phalanx bone P of the thumb T when the first switch portion 60 is donned. The first switch portion 60 may extend along the length of the user's thumb T and cover the entire length of the thumb T, or the tip of the thumb T may be exposed, as depicted.

The first switch 14 is secured to the first switch portion 60 in any suitable manner, such as with adhesive or by other means. The first switch 14 may be secured to the exterior surface of the first switch portion 60, as depicted in the FIGURES. In the alternative, the first switch 14 may be secured to an interior surface of the first switch portion 60 or may otherwise be imbedded within the first switch portion 60, and a graphical depiction of the switch may be provided on the exterior surface to indicate the placement of the first switch 14.

Figure 3:
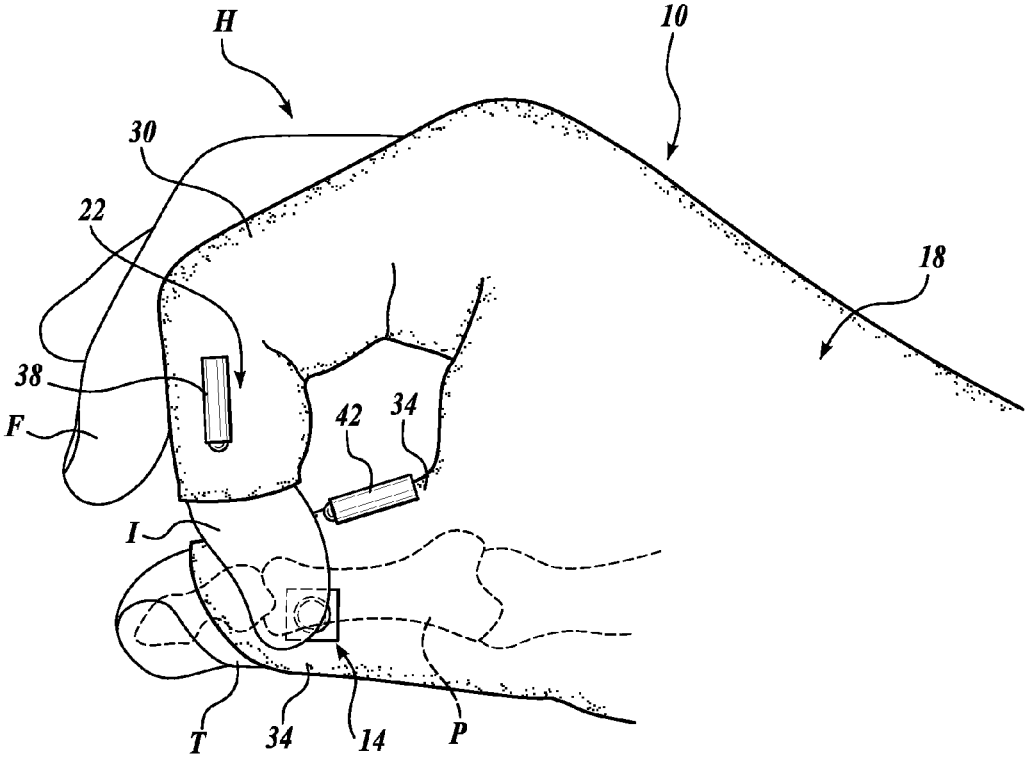
FIG. 3 is an isometric view of the one-handed activation device of FIG. 2, wherein the first switch is shown being activated.

Referring additionally to FIG. 3, the first switch 14 is secured to the first switch portion 60 such that the first switch 14 is positioned on the dorsal or extensor surface of the thumb T, and the first switch 14 overlies the proximal phalanx bone P of the thumb T when the first switch portion 60 is donned. In this manner, the user can access the first switch 14 with one of his or her fingers on the same hand as the switch 14 to activate or deactivate the illumination assembly 22.

More specifically, the first switch 14 is not located on a portion of the hand (such as the wrist, the cuff, or the back of the hand) that is inaccessible by the fingers or thumb of that same hand that would require the user to activate the first switch 14 with the opposite hand. In addition, the first switch 14 is not located on or near the palmar surface of the hand H such that the first switch 14 could be inadvertently activated when the user is gripping or maneuvering an object. Moreover, with the first switch 14 positioned to overlie the extensor surface of the proximal phalanx bone P of the thumb T when the first switch portion 60 is donned, the first switch 14 is within reach of the fingertip of at least the index finger I and the middle finger F.

Accordingly, the placement of the first switch 14 overlying the dorsal, extensor surface of the thumb T and overlying the proximal phalanx bone P of the thumb T allows the user to access the first switch 14 with his or her fingers on that hand for one-handed use of the illumination assembly 22.

Figure 4:
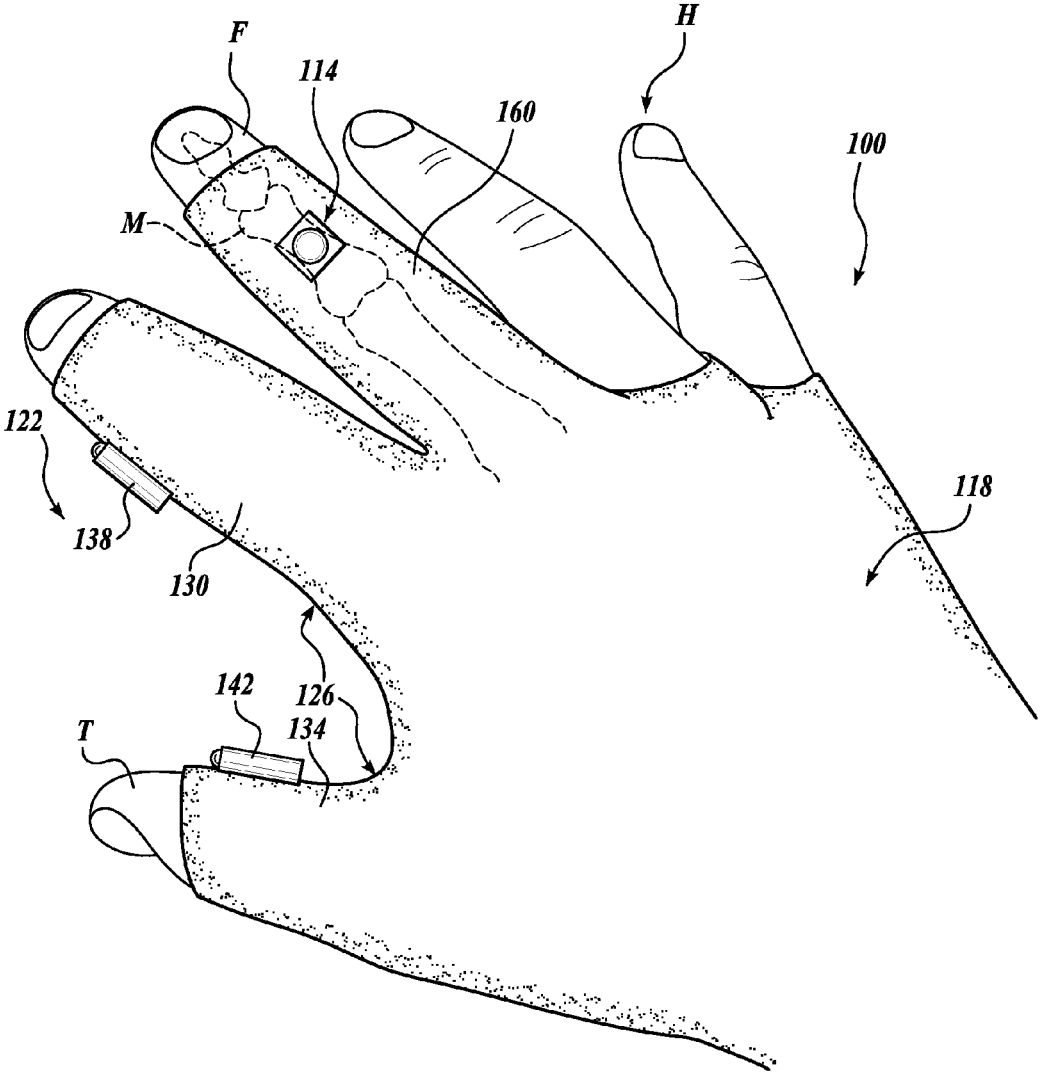
FIG. 4 is an isometric view of a second embodiment of one-handed activation device having a second switch on a surface of the one-handed activation device.
Figure 5:
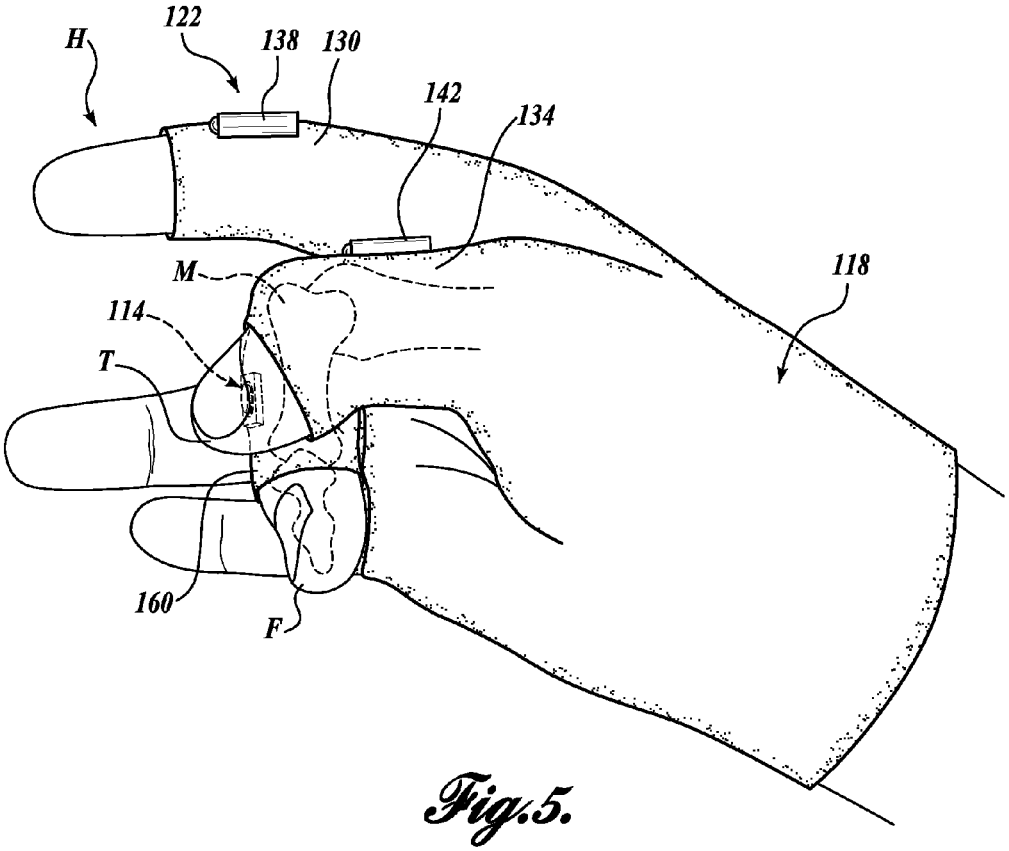
FIG. 5 is an isometric view of the one-handed activation device of FIG. 4, wherein the second switch is shown being activated.

Referring to FIGS. 4 and 5, an alternative embodiment of a one-handed activation device 100 will now be described. The one-handed activation device 100 is substantially similar to the one-handed activation device 10 described above except for the differences hereinafter described. In general, the one-handed activation device 100 includes a second switch 114 secured to a finger portion of a hand attachment assembly 118, wherein the second switch 114 substantially overlies a dorsal or extensor surface of a finger of the user's hand. The second switch 114 is configured to selectively activate an activatable device, such as an illumination assembly 122 secured to a portion of the hand attachment assembly 118.

The hand attachment assembly 118 includes an activatable device attachment potion 126 with an index finger portion 130 and a thumb portion 134, similar to the hand attachment assembly 18 described above. First and second light sources 138 and 142 are also similarly secured to the index finger portion 130 and a thumb portion 134, respectively.

The hand attachment assembly 118 also includes a second switch portion 160 that is securable to a user's finger to position the second switch 114 in a predetermined, accessible location on the user's finger when donned. In the depicted embodiment, the second switch portion 160 covers a portion of the user's middle finger F. However, it should be appreciated that the second switch portion 160 may instead be configured to cover a portion of the user's index finger, ring finger, or small finger in the same manner.

The second switch portion 160 substantially covers the middle phalanx bone M of the middle finger F when the second switch portion 160 is donned. The second switch portion 160 may extend along the length of the user's middle finger F and cover the entire length of the middle finger F, or the tip of the middle finger F may be exposed, as depicted.

As noted above, the second switch portion 160 is configured to secure the second switch 114 in a predetermined, accessible location on the user's middle finger F when donned. Similar to the first switch 14, the second switch 114 may be any suitable switch configured to selectively activate the first and second light sources 138 and 142 of the illumination assembly 122. Moreover, the second switch 114 may be secured to the exterior and/or interior surface of the second switch portion 160 in any suitable manner, such as with adhesive or by other means.

The second switch 114 is secured to the second switch portion 160 such that the second switch 114 is positioned to overlie the dorsal or extensor surface of the middle finger F, and the second switch 114 overlies the middle phalanx bone M of the middle finger F when the second switch portion 160 is donned. In this manner, the user can access the second switch 114 with his or her thumb T on the same hand as the second switch 114 to activate or deactivate the illumination assembly 122.

More specifically, the second switch 114 is not located on a portion of the hand (such as the wrist, the cuff, or the back of the hand) that is inaccessible by the thumb of that same hand such that it would require the user to activate the second switch 114 with the opposite hand. In addition, the second switch 114 is not located on or near the palmar surface of the hand H such that the second switch 114 could be inadvertently activated when the user is gripping or maneuvering an object. Moreover, with the second switch 114 positioned to overlie the extensor surface of the middle finger F and the middle phalanx bone M of the middle finger F when the second switch portion 160 is donned, the second switch 114 is within reach of the thumb T. Accordingly, the placement of the second switch 114 allows the user to access the second switch 114 with his or her thumb T on that hand for one-handed use of the illumination assembly 122.

As noted above, the second switch portion 160 may instead be configured to cover a portion of the user's index finger, ring finger, or small finger in the same manner. In that regard, the second switch portion 160 would be configured to substantially overlie the middle phalanx bone M and the dorsal, extensor surface of the index finger, ring finger, or small finger when the second switch portion 160 was donned. Thus, while illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A one-handed activation device comprising:

(a) a hand attachment assembly comprising:

(i) an activatable device attachment portion securable to at least a portion of a user's hand; and (ii) a first switch portion securable to at least a portion of one of a proximal phalanx of a user's thumb and a middle phalanx of a user's finger;

(b) an activatable device configured to be selectively activated, the activatable device secured to the activatable device attachment portion;

(c) a first switch configured to selectively activate the activatable device, wherein the first switch is secured to the first switch portion and positioned such that the first switch substantially overlies an extensor surface of one of the proximal phalanx of the user's thumb and the middle phalanx of the user's finger; and (d) a second switch portion secured to at least a portion of the other of the proximal phalanx of the user's thumb and the middle phalanx of the user's finger.

2. The device of claim 1, further comprising a second switch secured to the second switch portion, the second switch configured to selectively activate the activatable device.

3. The device of claim 1, wherein the activatable device is an illumination device.

4. The device of claim 1, wherein the hand attachment assembly is a glove.

5. A one-handed activation device for use on a user's hand, the user's hand having a thumb and first and second fingers extending from a body portion defined by a palm and a back side, the one-handed activation device comprising:

(a) a hand attachment assembly configured to be donned on a user's hand, the hand attachment assembly comprising:

(i) a hand attachment assembly body portion configured to be donned on at least a portion of the body portion of the user's hand;

(ii) an activatable device attachment portion configured to be automatically donned on one of an extensor portion of a proximal phalanx of a user's thumb and an extensor portion of a middle phalanx of a user's first finger; and (iii) a first switch portion configured to be automatically donned on the other of the extensor portion of the proximal phalanx of the user's thumb and the extensor portion of the middle phalanx of the user's first finger;

(b) an activatable device configured to be selectively activated, the activatable device secured to the activatable device attachment portion; and (c) a first switch configured to selectively activate the activatable device, wherein the first switch is secured to the first switch portion.

6. The device of claim 5, wherein the hand attachment assembly further comprises a second switch portion configured to be automatically donned on an extensor portion of a middle phalanx of a user's second finger.

7. The device of claim 6, further comprising a second switch secured to the second switch portion, the second switch configured to selectively activate the activatable device.

8. The device of claim 5, wherein the activatable device is an illumination device.

9. The device of claim 5, wherein the hand attachment assembly is a glove.

10. A method for using a one-handed activation device on a hand with at least a thumb and first and second fingers extending from a body portion defined by a palm and a back side, the method comprising:

(a) providing a one-handed activation device comprising:

(i) a hand attachment assembly configured to be donned on a user's hand, the hand attachment assembly comprising:

a hand attachment assembly body portion configured to be donned on at least a portion of the body portion of the user's hand;

an activatable device attachment portion configured to be automatically donned on one of an extensor portion of a proximal phalanx of a user's thumb and an extensor portion of a middle phalanx of a user's finger; and a first switch portion configured to be automatically donned on the other of the extensor portion of the proximal phalanx of the user's thumb and the extensor portion of the middle phalanx of the user's finger;

(ii) an activatable device configured to be selectively activated, the activatable device secured to the activatable device attachment portion; and (iii) a first switch configured to selectively activate the activatable device, the first switch secured to the first switch portion;

(b) donning the one-handed activation device such that the first switch automatically and substantially overlies the extensor surface of the other of the proximal phalanx of the thumb and the middle phalanx of the finger; and (c) selectively activating the first switch with a finger if the first switch portion is secured on the proximal phalanx of the thumb, and selectively activating the first switch with the thumb if the first switch portion is secured on the middle phalanx of the finger.

11. The method of claim 10, wherein the hand attachment assembly further comprises a second switch portion configured to be automatically donned on an extensor portion of a middle phalanx of a user's second finger.

12. The method of claim 11, further comprising a second switch secured to the second switch portion, the second switch configured to selectively activate the activatable device.

13. The method of claim 10, wherein the activatable device is an illumination device.

14. The method of claim 10, wherein the hand attachment assembly is a glove.

* * * * *